United States Patent [19]

Yoshimoto

[11] 4,153,263

[45] May 8, 1979

[54] BALL SKATE

[76] Inventor: Koichi Yoshimoto, #3-15-310, Takaodori, 4-chome, Nata-ku, Kobe, Japan

[21] Appl. No.: 859,174

[22] Filed: Dec. 9, 1977

[30] Foreign Application Priority Data

Jun. 22, 1977 [KR] Rep. of Korea ..... 77-4064

[51] Int. Cl.[2] ..... A63C 17/24

[52] U.S. Cl. ..... 280/11.1 BR; 280/11.14; 280/11.19; 280/11.26

[58] Field of Search ..... 280/11.1 BR, 11.1 R, 280/11.26, 11.14, 11.22, 11.23, 11.19, 11.27, 11.25; 180/7 R; 16/18 A, 24, 26

[56] References Cited

U.S. PATENT DOCUMENTS

| | | | |
|---|---|---|---|
| 10,331 | 5/1883 | Pederson | 16/18 A |
| 334,281 | 1/1886 | Punches | 280/11.14 |
| 388,693 | 8/1888 | La Chaine | 280/11.14 |
| 577,628 | 2/1897 | Segerberg | 280/11.25 |
| 2,166,767 | 7/1939 | Petermann | 280/11.22 |
| 2,212,589 | 8/1940 | Decker | 280/11.25 |
| 2,557,331 | 6/1951 | Wintercorn | 280/11.28 |
| 3,993,318 | 11/1976 | Rothmayer | 280/11.26 |

FOREIGN PATENT DOCUMENTS

| | | | |
|---|---|---|---|
| 591087 | 1/1934 | Fed. Rep. of Germany | 280/11.1 R |
| 1122229 | 9/1956 | France | 280/11.22 |

*Primary Examiner*—David M. Mitchell
*Attorney, Agent, or Firm*—Finnegan, Henderson, Farabow & Garrett

[57] ABSTRACT

A ball skate having the bearing portions of the axles for hemispherical rollers inclined toward the skating surface for presenting substantially tangential relationship of the rollers at the skating surface. The platforms are spring-mounted over the rollers and the main support member between the axle is preferably adjustable in length.

10 Claims, 4 Drawing Figures

BALL SKATE

BACKGROUND OF THE INVENTION

1. Field of the Invention

This invention pertains to ball skates and more particularly to ball skates having opposed hemispherical rollers.

2. Description of the Prior Art

Ball skates are known but their use has been practically confined to very smooth skating surfaces. In addition, the ends of the axles of the ball rollers tend to catch on the skating surface when skating in a tight curve and an area of the side of the ball roller is in contact with the skating surface.

Accordingly, it is the principal object of this invention to improve the performance of ball skates.

It is a further object of this invention to increase the utility and comfort of ball skates on a relatively rough skating surface.

It is a still further object of this invention to provide a ball skate without axle projections extending through the rollers which tend to catch on the skating surface while skating in a curve.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

To achieve the foregoing objects and in accordance with the purpose of the invention, as embodied and broadly described herein, the ball skate of this invention comprises a support member including an elongated body portion having pedestals depending therefrom at each end; a pair of like axles mounted one in each of the pedestals at the outer ends thereof, each axle having a bearing portion at each end, the bearing portions being inclined away from the body portion; two pairs of opposed hemispherical rollers, each hemispherical roller being rotatably mounted through its radius normal to its planar surface on a respective one of said bearing portions; and at least one platform mounted on said body portion on the side thereof opposite the rollers.

Preferably, the ends of the axles have threaded portions, the rollers are assembled on the axles by nuts on the threaded portions and each of the rollers includes a recess in its curved surface for containing the threaded portion and the nut at the end of the axle. Also, preferably, the platforms are spring-mounted on the support member and the elongated body portion includes two sections with aligned slots therein for adjusting the length of the body portion.

BRIEF DESCRIPTION OF THE DRAWINGS

The accompanying drawings, which are incorporated in and constitute a part of this specification, illustrate the preferred embodiment of the invention and, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

Figure 1:
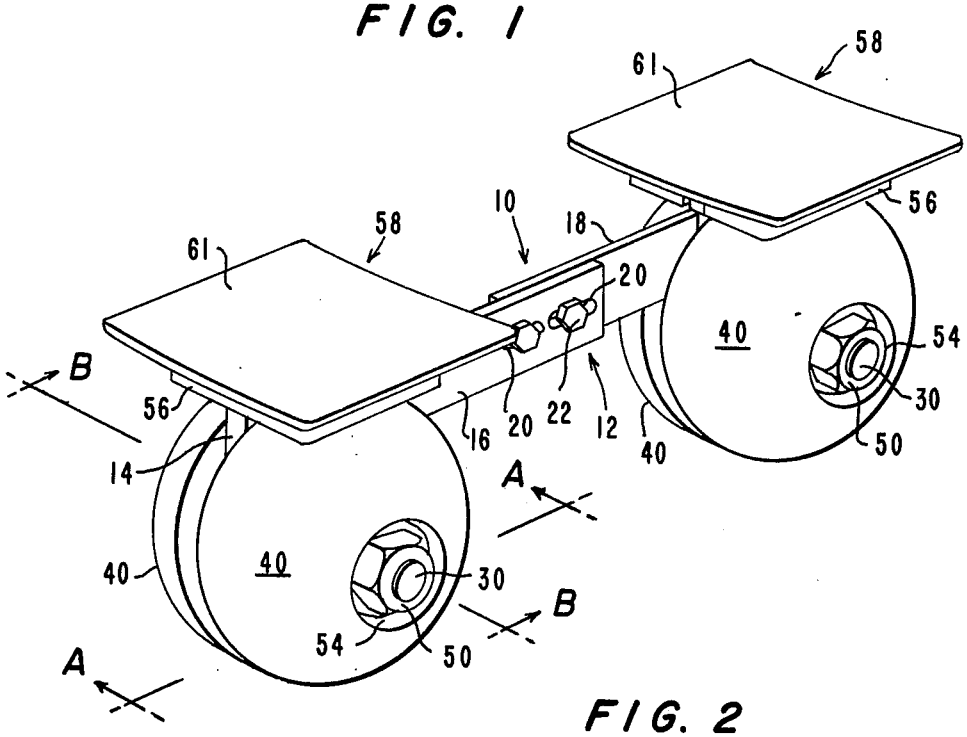
FIG. 1 is a perspective view of the preferred embodiment of the ball skate of the invention.
Figure 2:
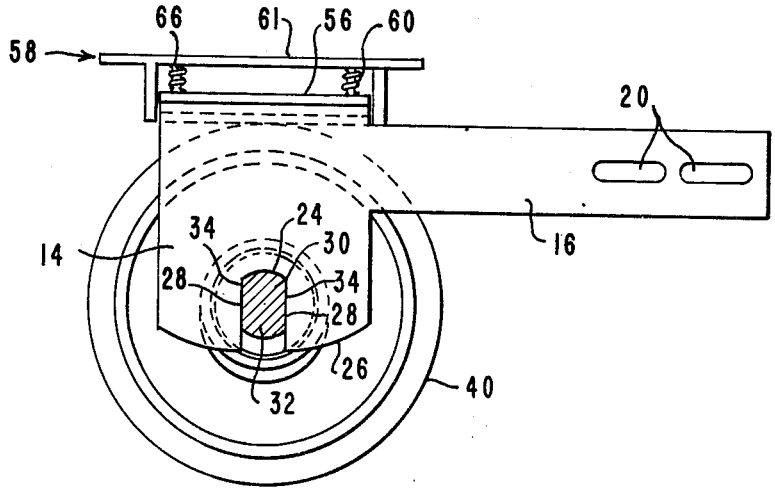
FIG. 2 is a cross-section of the front portion of FIG. 1 taken along the lines A—A.
Figure 3:
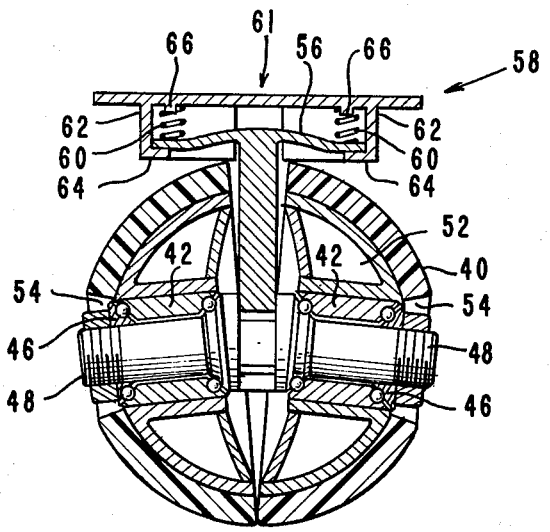
FIG. 3 is a sectional view of the embodiment of FIG. 1 taken along lines B—B thereof.

In accordance with the invention, as shown in FIGS. 1 and 2, the support member, shown generally as 10, includes an elongated body portion shown generally as 12 having pedestals 14 (only one being shown) depending therefrom. The elongated body portion 12 is preferably composed of two overlapping sections 16, 18 having aligned slots 20 for adjusting the length of the body portion to the size of the shoe of the skater. The overlapping sections 16, 18 are held in adjusted position by a pair of bolts 22 through the aligned slots 20.

Each of the pedestals 14 includes a channel 24 opening into the end 26 of the pedestal opposite the body portion 12. The sides 28 of the channel 24 are substantially parallel.

Figure 4:
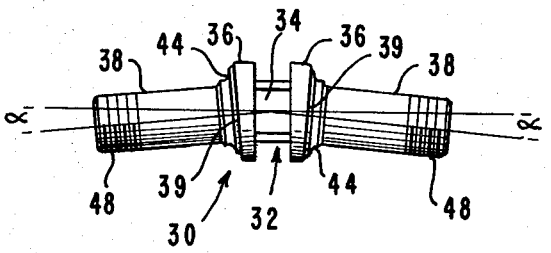
FIG. 4 is a front view of the axle of the embodiment of FIG. 1.

As embodied herein, the skate of the invention includes a pair of like axles 30 mounted one in each of the channels 24 of the pedestals 14. Each of the axles 30 includes a central portion 32, as shown in FIG. 4, having flattened sides 34 for insertion into the corresponding channel 24 for mounting the axle in the pedestal.

As embodied herein, each central portion 32 of an axle 30 is contained between encircling shoulders 36 for receiving the associated pedestal 14 therebetween.

In accordance with the invention, the bearing portions 38 of each axle are inclined away from the elongated body portion 12 by an angle $\alpha$. In other words, each axle 30 has the axis of its bearing portions at an angle $\alpha$ with the axis of the central portion 32, the plane of the angle $\alpha$ being parallel to the flattened sides 34 of the central portion 32 and the parallel sides 28 of the channel 24. The outer sides 39 of the encircling shoulders 36 are tapered to compensate for the angle of inclination of the bearing portions 38 of the axle 30.

As embodied herein, a pair of hemispherical rollers 40 is mounted on each of the axis 30 by roller bearing means 42. An inner bearing race 44 is positioned between each bearing portion 38 and shoulder 36 and may be an integral part of the axle 30. Outer bearing races 46 encircle each axle 30 respectively toward the outer ends thereof.

The outer ends of the axles 30 have threaded portions 48 for receiving nuts 50 and retaining the hemispherical rollers 40 and roller bearing means 42 in assembled position with the axles.

Preferably, each hemispherical roller 40 is hollow, including an annular inner channel 52. The composition of the materials of which the rollers 40 are fabricated is not part of this invention and the hemispherical rollers may be manufactured by any convenient means and materials known in the art.

Each of the hemispherical rollers 40 includes a recess 54 into which the outer end of the axle 30 extends. The threaded portion 48 of the axle 30 and the nut 50 at each end of the axle are contained in the recess 54.

In accordance with the invention, the elongated body portion 12 with its depending pedestals 14 is substantially planar. As embodied herein, the body portion 12 includes at each end thereof an integral table member substantially perpendicular to each pedestal. Preferably, the table member 56 is rectangular in configuration.

Platform 58 is mounted on each table member 56 through springs 60. Each platform 58 includes an upper planar portion 61 and frame members 62 depending therefrom substantially tangent with the perimeter of the associated table member 56. Extending from the frame members 62 are flange portions 64 inclined inwardly toward the pedestals 14 and in contact with the lower surface of the associated table member 56. The springs 60 are contained within the frame members 62 and bias the platform 58 outwardly from the table member 56, thus forming an abutting contact between the flanges 64 and the lower surface of the table members 56.

Preferably, the springs 60 are coil springs and are located at the corners of the rectangular table member 56, being retained in their respective positions by studs 66 depending from the lower surface of the platform 58, the studs being encircled by the coil springs 60.

Also preferably, the edges of the upper planar portions 61 of the platform 58 extend outwardly in each direction beyond the table members 56 and the frame members 62 forming a substantial planar base for the skating boot (not shown).

Preferably, the angle of inclination of the bearing portions 38 with the central portion 32 of the axles 30 is fixed to produce a substantially tangential relationship of the curved surfaces of the hemispherical rollers 30 at the point of contact of the rollers with the skating surface when the plane of the pedestals is normal to the skating surface.

It will be apparent to those skilled in the art that various modifications and variations could be made in the skate of the invention without departing from the scope or spirit of the invention.

What is claimed is:

1. A ball skate comprising:

a support member including an elongated body portion having pedestals depending therefrom at each end;

a pair of like axles mounted one in each of said pedestals at the outer ends thereof, each axle having a bearing portion at each end;

two pairs of opposed hemispherical rollers each roller being rotatably mounted through its axis normal to its planar surface on a respective one of said bearing portions;

said bearing portions being inclined away from said body portion at an angle providing substantially tangential relationship between the rollers at the point farthest from the body portion as to rollers mounted on the same axle to form a ball-like surface; and at least one platform mounted on said body portion on the side thereof opposite said rollers.

2. The ball skate of claim 1 wherein each of said pedestals includes a channel opening into the end opposite said body portion, the sides of the channel being substantially parallel and each axle including a central portion having flattened sides for insertion into the corresponding channel for mounting the axles in the pedestals.

3. The ball skate of claim 2 wherein each of said axles includes a pair of encircling shoulders for receiving the associated pedestal therebetween.

4. The ball skate of claim 3 also including ball bearing means for mounting said hemispherical rollers on said bearing portions and wherein said shoulders each includes an inner race for said ball bearing means.

5. The ball skate of claim 4 wherein each of said axles has a threaded portion at its outer end and wherein said ball bearing means includes an outer race encircling the axle and said skate includes nut means threaded on said threaded portions for holding the rollers and ball bearing means in assembled position.

6. The ball skate of claim 5 wherein each of said hemispherical rollers has a recess in its curved surface and the outer ends of said threaded portions and said nut means are contained within said recesses.

7. The ball skate of claim 1 including springs between said support member and said platform.

8. The ball skate of claim 1 including a platform mounted on said body portion above each axle.

9. The ball skate of claim 8 wherein said body portion includes an integral table member substantially perpendicular to each pedestal and forming the outer surface of the body portion and wherein each platform includes depending frame portions with inwardly inclined flanges cooperating with the lower surface of the associated table member, the skate including spring means for biasing the flanges against said lower surface of the table member, said spring means being positioned between the table member and the platform.

10. The ball skate of claim 9 wherein each said table member is substantially rectangular and wherein each platform includes a correspondingly rectangular outer surface, the edges of the outer surface extending outwardly beyond the table member in each direction, and wherein said spring means includes a coil spring positioned at each corner of said rectangular table member, each platform having depending studs for retaining the coil springs in position.

* * * * *